United States Patent [19]

Dal Negro

[11] 4,058,144

[45] Nov. 15, 1977

[54] TAPE-SUPPORTED SLIDE-FASTENER ELEMENT

[75] Inventor: Ruggero Dal Negro, Milan, Italy

[73] Assignee: Italo Americana Prentice S.p.A., Milan, Italy

[21] Appl. No.: 201,738

[22] Filed: Nov. 24, 1971

Related U.S. Application Data

[63] Continuation-in-part of Ser. No. 21,778, March 23, 1970.

[30] Foreign Application Priority Data

| | | |
|---|---|---|
| Mar. 21, 1969 | Italy | 14395/69 |
| Dec. 12, 1969 | Italy | 25704/69 |

[51] Int. Cl.[2] ..... A44B 19/04

[52] U.S. Cl. ..... 139/384 B; 24/205.16 C

[58] Field of Search ..... 24/205.1 C, 205.16 C, 24/205.15 R; 139/384 B

[56] References Cited

U.S. PATENT DOCUMENTS

| | | | |
|---|---|---|---|
| 1,813,227 | 7/1931 | Blair | 24/205.15 R |
| 3,002,245 | 10/1961 | Burbank | 24/205.16 C |
| 3,022,803 | 2/1962 | Berberich et al. | 139/384 B |
| 3,058,188 | 10/1962 | Yoshida | 139/384 B |
| 3,143,779 | 8/1964 | Hendley | 24/205.16 C |
| 3,454,052 | 7/1969 | Burbank | 139/384 B |
| 3,487,511 | 1/1970 | Frohlich | 139/384 B |

*Primary Examiner*—Henry S. Jaudon
*Attorney, Agent, or Firm*—Karl F. Ross

[57] ABSTRACT

A slide-fastener element of the monofilamentary-coil type is held in position on a stringer tape, woven from a set of warp threads and a continuous weft thread, by a core traversing the turns of the coil, the core being anchored to the tape by the weft thread which is interwoven with a first set of ancillary warp threads above the coil and with a second set of ancillary warp threads below the coil.

5 Claims, 12 Drawing Figures

INVENTOR:
Ruggero Dal Negro

BY

Karl F. Ross
Attorney

Ruggero Dal Negro
INVENTOR.

BY

Karl F. Ross
Attorney

Ruggero Dal Negro
Inventor.

By Karl F. Ross
Attorney

TAPE-SUPPORTED SLIDE-FASTENER ELEMENT

This application is a continuation-in-part of my pending application Ser. No. 21,778 filed Mar. 23, 1970.

My present invention relates to a slide fastener of the type wherein, in each of its halves, a coiled fastener element is interwoven with textile threads or other filaments constituting a stringer tape.

In my prior U.S. Pat. No. 3,480,045 I have disclosed a loom for weaving such a stringer tape with a slide-fastener element anchored thereto by a continuous weft thread which, during the weaving process, is inserted into the shed between the warp threads from the side of the fastener coil so as to form double passes between these warp threads, successive passes being interconnected by thread portions looped around parts of the fastener coil to anchor the same to the fabric.

When a pair of such fastener halves are juxtaposed for engagement by a slider which brings about the interengagement of the coils with the aid of suitable coupling heads formed on the turns thereof, the slider must be guided by a pair of parallel edges provided on the two stringer tapes. In conventional slide fasteners these edges are formed by longitudinal beads with the aid of cords imbedded in the fabric, the cords generally having a larger diameter than the neighboring warp threads to which they are linked by the weft. The cords, being flexible, tend to yield to strong lateral stresses unless tightly bound into the fabric structure; in the latter case, however, the entire tape becomes more rigid so that the slider encounters greater resistance, whereas with loose binding the guidance is less accurate so that the slider may fail to interlink all the coupling heads when moving in the fastener-closing direction.

The general object of my present invention, therefore, is to provide a slide fastener avoiding the aforestated disadvantages.

It is also an object of my invention to provide an improved slide-fastener half of this description which can be quickly and easily made on a tape-weaving loom wuch as that disclosed and claimed in my above-identified prior patent.

It has already been proposed to guide a slider along a set of special warp threads enshrouding, in an array of substantially C-shaped cross-section, one side of a fastener coil whose ellipsoidal turns are traversed by a flexible cord (referred to hereinafter as a core) tied to these warp threads by lengths of weft thread which, forming part of a continuous thread, come to lie between the turns as they engage an array of main warp threads alongside the coil. Thus, the stringer tape woven from the weft and main warp threads is firmly anchored to the coil and its core, leaving exposed the coupling heads on the side of the coil not bracketed by the special warp threads.

In the operation of a slide fastener whose halves are constructed in the way just described, the slider bracketing the two coils with their respective arrays of special warp threads is essentially guided at four points, i.e. at the four corners of a rectangle defined by the two confronting C-shaped arrays. The four threads extending along these corners, termed corner warps, are therefore made heavier than the remainder of the special warp threads whose thickness, in turn, exceeds that of the regular or main warp alongside the coils in order to fill up the space between the coil and the upper and lower shield plates of the slider. If the two stringer tapes are not perfectly coplanar as the slider is moved to and fro, considerable stress may be exerted upon either pair of diagonally opposite corner warps which therefore, together with the enveloping sections of weft thread, are subjected to increased friction and consequent wear. A similar situation exists if the slider is canted, i.e. is pulled at an acute anlge to the direction of the coils. This leads to rapid deterioration of the corner warps and seriously limits the service life of the fastener.

Thus, a more specific object of my invention is to provide an improved slide-fastener half, of the general type set forth above, which does not depend upon a small number of oversized and wear-prone warp threads for the guidance of its slider.

In accordance with the present invention I provide a fastener coil and core enshrouded by an array of ancillary warp threads which, advantageously, are of the same thickness as the main warp threads connected therewith by the interwoven weft thread or threads, the profile of this array having substantially the form of more than half an ellipse conforming to a major part of the projected shape of the turns of the coil. Thus, the spacing of these ancillary warp threads from the plane of the stringer tape, longitudinally bisecting the turns of the coil, increases progressively from the side of the coil proximal to the main warp toward the opposite side bearing the coupling heads, this spacing being approximately constant along a median zone. Since these supporting warp threads rest in turn on the coil, rather than on other warp threads as do the corner warps of the conventional arrangement, the slider is positively guided and helps maintain the coils and their stringer tapes in an aligned position with virtually no tendency to cant.

The imbedded core, which is generally of substantially larger diameter than the warp threads, may consist of the same or different filamentary material and may be constituted by a multiplicity of intertwined or bundled fibers.

The ancillary warp threads bracketing the coil may consist of the same material as the main warp threads but, advantageously, can be coated with plastic material or otherwise made more wear-resistant than the remainder of the fabric.

These and other features of my invention will be described in greater detail with reference to the accompanying drawing in which.

Figure 1:
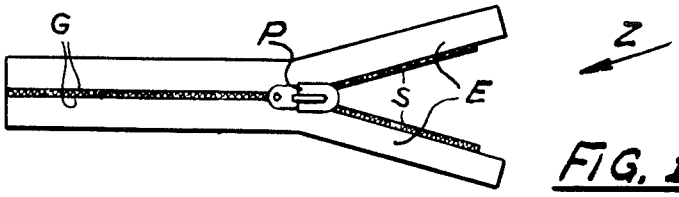
FIG. 1 is a top view of a slide fastener with a pair of fastener halves according to the invention.

In FIG. 1 I have shown a slide fastener, generally designated Z, which consists of two identical and mirror-symmetrical halves E partly interconnected with the aid of a slider P. The latter is guided along edges G formed, in a manner described hereinafter, by a raised portion of a pair of stringer tapes which, together with a pair of coils S partly embedded therein, constitute the fastener halves E.

Figure 2:
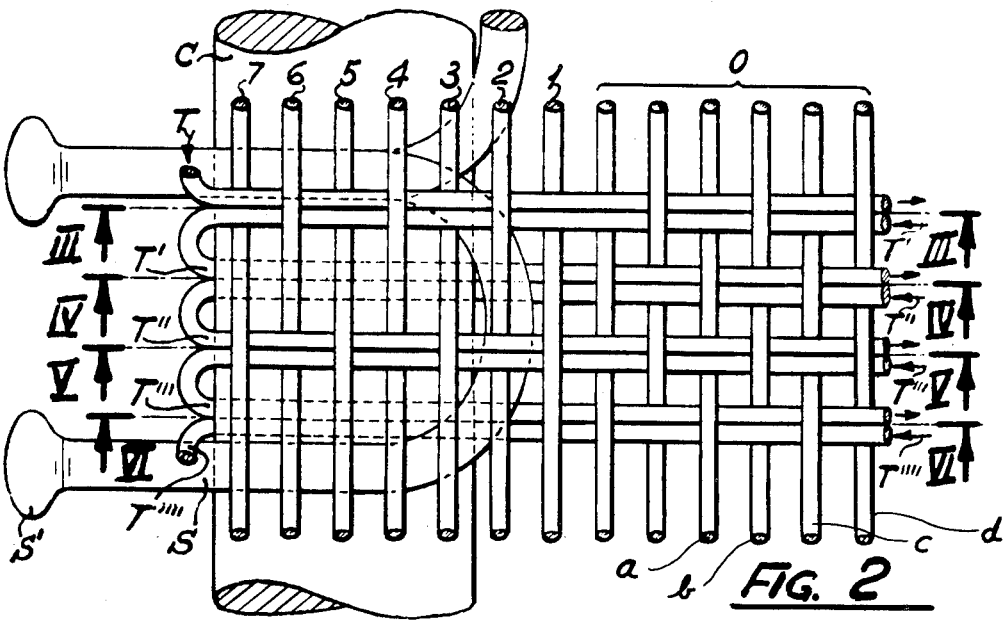
FIG. 2 is an enlarged fragmentary top view of one of the fastener halves shown in FIG. 1.

FIG. 2 shows, on a larger scale, a part of the coil S of the right-hand fastener half E of FIG. 1, this coil consisting of the usual monofilamentary thermoplastic material (e.g. nylon) and being formed with a coupling head S' on an exposed portion of each of its turn. As seen in FIGS. 3–6, these turns are of generally elliptical shape with the major axis of the ellipse lying in the plane of an array of main warp threads, generally designated O, forming part of the stringer tape. Two sets of ancillary warp threads, respectively designated 1–7 and 1'–7', extend above and below the fastener coil S on opposite sides of the plane of the warp threads O. A core C, e.g. in the form of a heavy textile cord, passes parallel to all the warp threads through the turns of coil S on the side of the ellipse remote from the coupling heads S' and proximal to the array O. The terms "above" and "below", which correspond to the geometrical orientation of the parts in FIGS. 3–6, are used hereinafter for convenience to designate the front and the rear of the fastener, respectively, i.e. its exposed or forward side visible in FIG. 1 and its opposite rear side.

Figure 4:
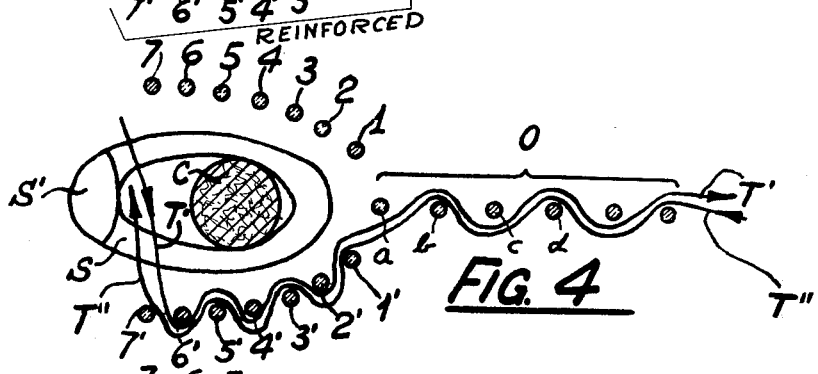

A continuous weft thread, taken advantageously from a loom of the type described in my prior U.S. Pat. No. 3,480,045, interlinks all the warp threads as well as the core C into a unitary fabric structure. During each operating cycle of the loom, a curved needle inserts this weft thread into the shed formed by the warp threads, from left to right as viewed in FIGS. 2–6, and thereafter retracts it through the same shed while a selvedge needle engages the thread loop at the opposite edge of the fabric. Thus, each insertion stroke results in a double pass of the weft thread, these passes having been designated T and T' for the first cycle depicted diagrammatically in FIG. 3. In this first cycle, alternate main warp threads *a, c* etc. as well as ancillary warp threads 1, 3, 5, 7 of the upper set are lowered beneath the insertion plane whereas the other main warp threads *b, d* etc. and ancillary warp threads 2, 4, 6 of the upper set are raised to form the shed; the lower ancillary warp threads 1'–7' do not become part of the shed and are not engaged by the weft at this time. Next, as shown in FIG. 4, the returning length of thread T' is looped around the core C between two successive turns of coil S as the coil and the core are raised by a special heddle of the loom harness above the needle plane, as are the main warp threads *a, c* etc. and alternate ancillary warp threads 2', 4', 6' of the lower set; the remaining main warp threads *b, d* etc. and lower ancillary warp threads 1', 3', 5', 7' now form the lower boundary of the shed which at this stage does not include any of the upper ancillary warp threads 1–7. During this loom cycle, therefore, the thread portion T' forms a forward pass between the shedded warp threads and, after being linked with the loop previously engaged by the selvedge needle, returns through the same shed as a pass T'' which thereafter is looped again around the core C between the two aforementioned turns of coil S as the coil and the core are lowered once more to let the upper ancillary warp threads 1–7 participate in the shed-forming process.

Figure 5:
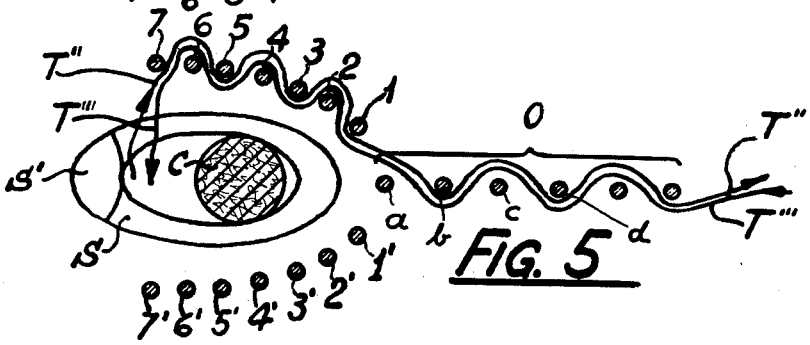
Figure 6:
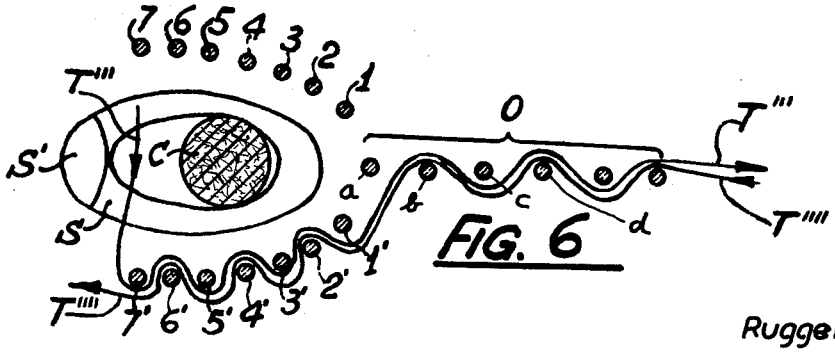

As illustrated in FIG. 5, the third cycle is similar to the first one (FIG. 3) except for a reversal of the relative position of ancillary warp threads 1–7; the insertion of the weft needle produces a forward pass T'' (as a continuation of the identically designated return pass of the preceding cycle) and a return pass T''' which thereafter, as illustrated in FIG. 5, embraces once more the core C between the two aforementioned turns of coil S before traversing a shed FIG. 6 which differs from that of FIG. 4 only by the reversal of the relative position of the lower ancillary warp threads 1'–7'. The return pass T'''' is carried across the adjoining turn of the coil whereupon the sequence of operations is performed between that turn and the next-following one.

Thus, there is produced a fabric intimately anchored to the core C and the coil S as best seen in FIG. 2; the double layer of warp threads 1–7 and 1'–7', together with the intervening core C, defines a raised edge G (FIG. 1) for the guidance of the slider P in the vicinity of ancillary warp threads 1, 1', thus substantially along a line tangent to the outer vertices (opposite the heads S') of the turns of the coil S.

The generally elliptical profile of the coils, as projected upon a plane transverse to the longitudinal direction of the fastener, is symmetrical about the plane of the main warp, i.e. of the stringer tapes seen in FIG. 1. The spacing of ancillary warp threads 1, 2, 3 etc. from this median plane increases progressively to about thread 5, remaining substantially uniform for the remaining threads.

Figure 12:
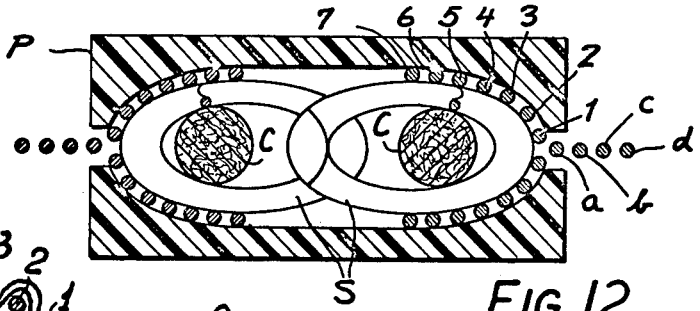
FIG. 12 is a cross-sectional view of a slider engaging two coupled fastener halves according to the invention.

FIG. 12 illustrates how the two coils S, each with its own core C and associated main and ancillary warp threads (the weft threads having been omitted for the sake of clarity), is engaged by the slider P whose upper and lower shield plates bear upon the coils by way of the ancillary warp threads. The slider P, as shown, has a substantially elliptical outline so as to be supported by at least the majority of the ancillary warp threads, thus uniformly distributing the frictional forces over the array of each slide-fastener half, thereby substantially reducing the wear of these ancillary warp threads. The small thickness of the ancillary warp threads, equaling or approximating that of the main warp *a, b, c, d,* etc., contributes to the relative stability of the assembly, S, P in the aforementioned transverse plane.

Figure 7:
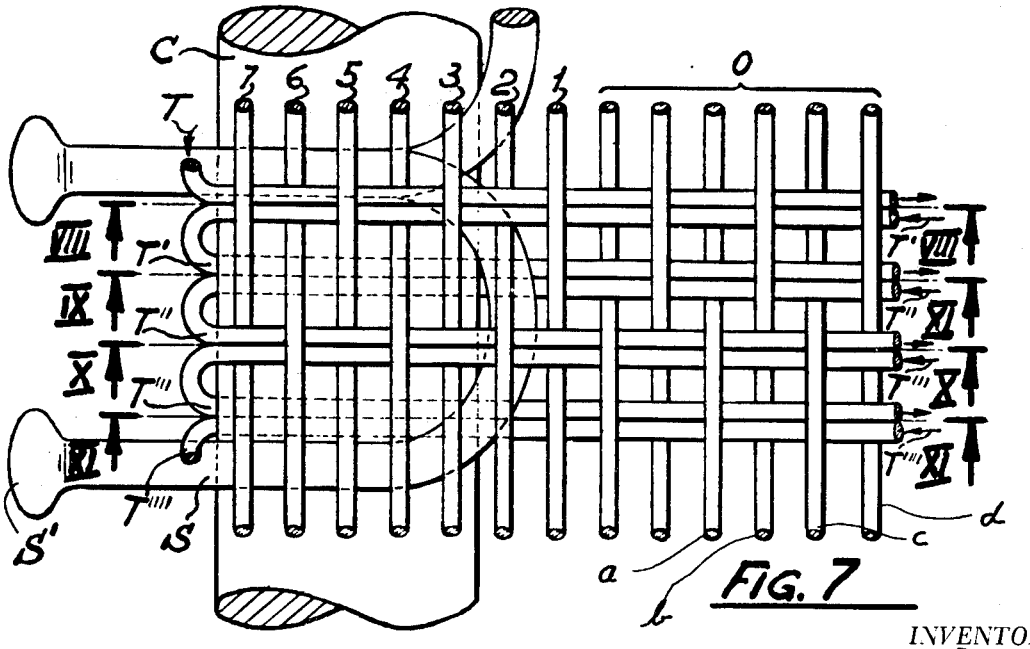
FIG. 7 is a view similar to FIG. 2, showing a modification.
Figure 3:
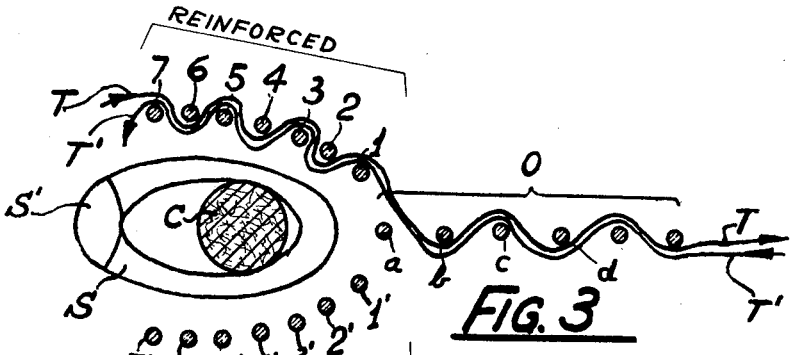
FIGS. 3–6 are somewhat diagrammatic cross-sectional views taken on the lines III—III, IV—IV, V—V and VI—VI, respectively, of FIG. 2.
Figure 8:
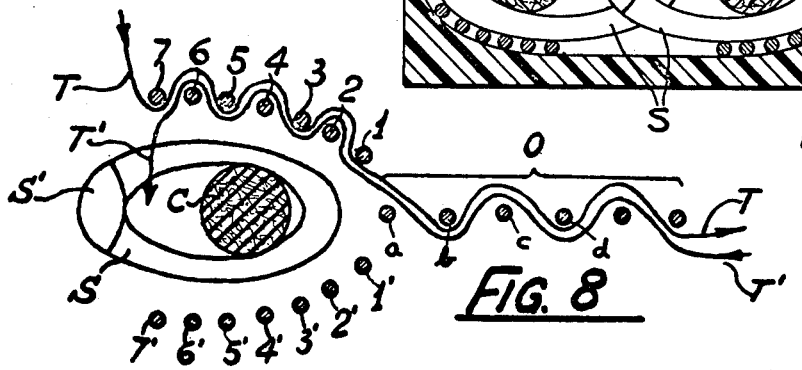
FIGS. 8–11 are views similar to FIGS. 3–6, taken respectively on lines VIII—VIII, IX—IX, X—X and XI—XI of FIG. 7.
Figure 9:
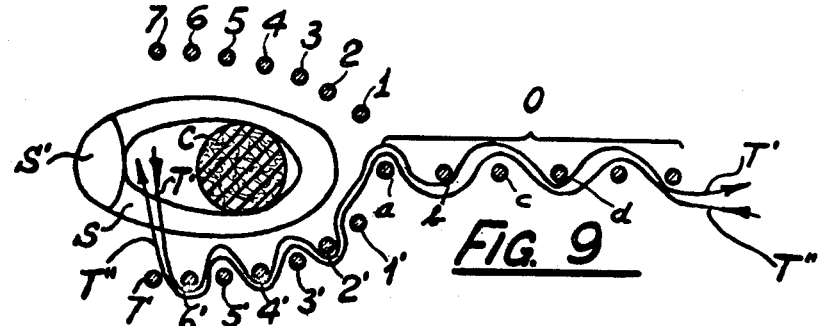
Figure 10:
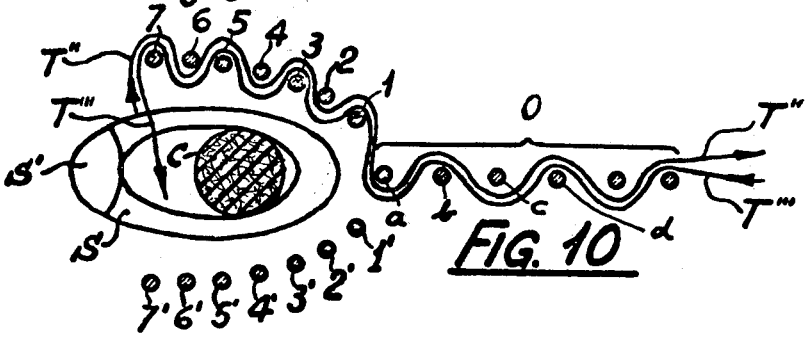
Figure 11:
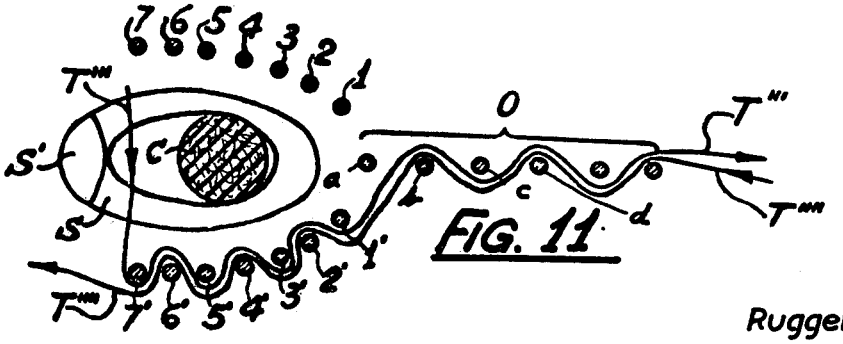

The weaving pattern illustrated in FIG. 2–6 produces twice as many inversions per unit of length along the main warp threads O as along the ancillary warp threads 1–7 and 1'–7'. With relatively heavy threads, therefore, four double passes as described above may be difficult to fit between two adjacent turns of the coil. In such a situation, therefore, a modified pattern as illustrated in FIGS. 7–11 may be preferable. In that instance, as shown in FIGS. 8 and 9, the relative position of the main warp threads O does not change between the first and second cycles; a reversal of these warp threads, occurring between the second and third cycles, is maintained through the fourth cycle as illustrated in FIGS. 10 and 11. Thus, as best seen in FIG. 7, a pair of double passes come to lie above warp threads *a, c* and below warp threads *b, d* while engaging the upper and the lower ancillary warp threads 1–7 and 1'–7', respectively; another pair of double passes, also engaging these ancillary warp threads, extend below warp threads *a, c* and above warp threads *b, d.* Thus, there are only as many inversions per unit length in tape section O as in the extensions thereof formed by threads 1–7 and 1'–7', i.e. one inversion per warp thread between any two consecutive turns of the coil; the passes of the weft thread, therefore, can be bunched as closely as necessary (possibly with overlapping) to fit between these turns.

Naturally, the number of ancillary warp threads will depend on the size of the coil, the thickness of the thread and other parameters. These ancillary warp threads need not be made of the same material as the main warp threads O and/or the weft T.

As indicated in FIG. 2, the ancillary warp threads 1–7 and 1′–7′ (or at least some of them) may be sized or treated with a reinforcing agent, e.g. Teflon, to increase their wear resistance.

I claim:

1. In a slide fastener, in combination, a pair of slide-fastener halves and a slider of substantially elliptical cross-section, each slide-fastener half comprising:

a fastener element in the shape of a continuous coil with spaced-apart turns of generally elliptical configuration;

a core extending longitudinally of said coil through said turns;

a set of main warp threads parallel to said core disposed alongside said coil in a median plane thereof;

a set of ancillary warp threads parallel to said core partly enshrouding said coil and resting on the turns thereof on the side adjacent said main warp threads, in an array diverging from said median plane above and below the coil, the spacing of said ancillary warp threads from said median plane increasing progressively to an intermediate zone of the coil remote from said main warp threads; and weft-thread means interwoven with all said warp threads to form a stringer tape, said weft-thread means passing around said core at said intermediate zone on the side remote from said warp threads to anchor said core to said stringer tape;

said slider straddling the coils of said slide-fastener halves while bracketing said ancillary warp threads, said slider bearing upon the coils of said fastener halves by way of at least the majority of said ancillary warp threads.

2. The combination defined in claim 1 wherein said ancillary warp threads are all of the same thickness.

3. The combination defined in claim 1 wherein said array has a profile of at least a semi-ellipse conforming to the configuration of said turns.

4. The combination defined in claim 1 wherein said coil consists of a resinous filament provided with coupling heads on said turns beyond said array of ancillary warp threads.

5. The combination defined in claim 1 wherein said weft-thread means comprises a continuous weft thread interwoven with all said warp threads in a succession of double passes to form a stringer tape, said double passes being interlinked by simple loops laid around said core on the side thereof remote from said main warp threads to anchor said core to said stringer tape, alternate double passes of said weft threads engaging the ancillary warp threads above and below said coil, all of said double passes engaging said main warp threads with inversion of alternate pairs of double passes relative to said main warp threads.

* * * * *